US005762435A

United States Patent [19]

Fukushima

[11] Patent Number: 5,762,435

[45] Date of Patent: Jun. 9, 1998

[54] CAP FOR WRITING INSTRUMENT

[75] Inventor: Makoto Fukushima, Kawagoe, Japan

[73] Assignee: Kotobuki & Co., Ltd., Kyoto-Hu, Japan

[21] Appl. No.: 681,360

[22] Filed: Jul. 23, 1996

[51] Int. Cl.[6] ..... B43K 9/00

[52] U.S. Cl. ..... 401/213; 401/202; 401/247

[58] Field of Search ..... 401/202, 213, 401/247

[56] References Cited

U.S. PATENT DOCUMENTS

| | | | |
|---|---|---|---|
| 2,958,085 | 11/1960 | Matschkal | 401/202 |
| 4,643,605 | 2/1987 | Iwasaki | 401/213 R |

FOREIGN PATENT DOCUMENTS

| | | | |
|---|---|---|---|
| 1461488 | 12/1966 | France | 401/202 |
| 1915566 | 10/1970 | Germany | 401/202 |
| 3223722 | 12/1983 | Germany | 401/213 |
| 3931983 | 4/1991 | Germany | 401/213 |
| 1139593 | 9/1989 | Japan . | |
| 628350 | 8/1949 | United Kingdom | 401/202 |
| 2249526 | 5/1992 | United Kingdom | 401/213 |

*Primary Examiner*—Steven A. Bratlie
*Attorney, Agent, or Firm*—Whitham, Curtis & Whitham

[57] ABSTRACT

A writing instrument includes a body, a writing tip projected from a tip end of the body, an ink supplying mechanism having low-viscosity ink contained therein for supplying the ink to the writing tip, the ink supplying mechanism being incorporated in the body and connected to the writing tip, and at least one ventilating clearance provided between the writing tip and the tip end of the body for facilitating the supplying of the ink to the writing tip. A cap for the writing instrument includes a cap body and a seal member provided in the cap body, the seal member being formed of elastic material. When the writing instrument is coupled with the cap, the seal member is tightly fitted on the tip end of the writing instrument body, whereby the writing tip and the ventilating clearances are completely sealed by the seal member.

4 Claims, 4 Drawing Sheets

CAP FOR WRITING INSTRUMENT

BACKGROUND OF THE INVENTION

1. Field of the Invention

This invention relates to a cap for a writing instrument, such as a ball-point pen, felt-tip pen or the like, and more particularly to an improvement of a cap for a writing instrument utilizing low-viscosity ink.

2. Description of the Prior Art

Referring to FIG. 1, a conventional cap of this type will be discussed in order to facilitate understanding of the present invention. The conventional cap of FIG. 1 is used for a writing instrument utilizing aqueous ink. The cap 1 includes an outer cap member 2, an inner cap member 3 of elastic plastic material fitted in the outer cap member 2, and a seal member 4 of rubber provided in the inner Gap member 3. The seal member 4 has a recess portion. The writing instrument includes a barrel 5 and a reservoir inserted in the barrel 5. The reservoir comprises a tubular body 6 having a fibrous member (not shown) filled therein, aqueous ink impregnated in the fibrous member, and an ink-passageway 6*a* extending from the reservoir body 6 for inducing ink from the reservoir body 6 to a writing tip 7 provided at a leading end of the ink-passageway 6*a*. The writing tip 7 is projected out of the barrel 5 via an opening 5*a* of the barrel 5. The barrel 5 is formed with a ventilating hole 5*b* at a region near a head portion thereof. The ventilating hole 5*b* acts as means to facilitate supplying of ink from the reservoir body 6 to the writing tip 7 during use of the writing instrument and for detachment of the writing instrument from the cap. More particularly, air can flow into the barrel 5 via the ventilating hole 5*b* and further flow into the reservoir body 6 via an air-inlet (not shown) formed in the reservoir body 6, thereby supplying ink to the writing tip 7.

The outer cap member 2 has a circumferential projection 2*a* formed on an inner surface region near an opened end thereof. The barrel 5 is formed in such a manner that an outside diameter thereof gradually increases in a rearward direction. When the writing instrument is coupled with the cap 1, the head portion of the barrel 5 is received in the inner cap member 3 and the writing tip 7 is received in the recess portion of the seal member 4. At this time, the ventilating hole 5*b* of the barrel 5 is sealed with an inner surface of the inner cap member 3, whereby the evaporation of ink from the writing tip 7 and drying of the writing tip 7 are prevented. Further, the barrel 5 is engaged with the circumferential projection 2*a* of the outer cap member 2 at its rearward section having an outer diameter larger than that of the head portion of the barrel 5. Thus, the barrel 5 is tightly coupled with the cap 1.

The conventional cap inevitably requires both the inner cap member 3 for sealing the ventilating hole 5*b* of the barrel 5 and the seal member 4 for sealing the writing tip 7, so that the number of parts making up the cap increases, resulting in increased costs to manufacture the cap.

As another conventional writing instrument, there has been proposed a writing instrument with a cap comprising only an outer cap member and an inner cap member provided in the outer cap member. In this conventional writing instrument, when the writing instrument is coupled with the cap, a ventilating hole of a barrel of the writing instrument is adapted to be sealed with the outer cap member and a writing tip is adapted to be sealed with the inner cap member. However, with this conventional writing instrument, when the cap is coupled with the writing instrument, the cap must be tightly fitted on the barrel in order that the evaporation and drying of ink can be prevented. For this purpose, it is essential that the outer cap member is made of any elastic material which allows the outer cap member to be elastically deformed in a manner to be tightly fitted on the barrel when the cap is coupled with the barrel. Therefore, material for the cap is limited. Further, the outer cap member functions as means for sealing the ventilating hole of the barrel, so that the shape of the outer cap member is also restricted.

SUMMARY OF THE INVENTION

It is therefore an object of this invention to provide a cap for a writing instrument, wherein the number of parts of the cap is reduced, and the shapes of and material for the parts are not limited.

It is another object of this invention to provide a cap for a writing instrument, wherein when the cap is coupled with the writing instrument, ventilating means provided between a writing tip and a head portion of a writing instrument body can be securely sealed with the cap.

It is still another object of this invention to provide a cap for a writing instrument, which can be easily manufactured.

In accordance with the present invention, there is provided a cap for a writing instrument. The writing instrument includes a body, a writing tip projected from a tip end of the body, ink supply means having low-viscosity ink contained therein for supplying the ink to the writing tip, the ink supply means having an air-inlet for allowing air to flow therein, incorporated in the writing instrument body and connected to the writing tip, and ventilating means provided between the writing tip and the tip end of the writing instrument body for facilitating the supplying of the ink to the writing tip. The ventilating means communicates between an interior of the writing instrument body and the environment. The cap comprises a cap body which is to be coupled with the tip end portion of the writing instrument body during nonuse of the writing instrument, and seal means provided in the cap body. The seal means is formed of elastic material. When the writing instrument is coupled with the cap, the seal means is tightly fitted on the tip end of the writing instrument body, whereby the writing tip and the ventilating means are completely sealed with the seal means.

The ventilating means may comprise at least one clearance means provided between the writing tip and the tip end of the writing instrument body.

The cap body may include support means for supporting the seal means. The support means may comprise ribs formed on an inner surface of a closed end portion of the cap body and spaced around the inner surface of the closed end portion of the cap body. The cap body may include retaining means for retaining the seal means in the cap body. The retaining means may comprise an undercut region formed in each of the ribs and a bulged portion formed at an end portion of each of the ribs which is near an opened end of the cap body.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same parts throughout the Figures and wherein.

DETAILED DESCRIPTION OF THE PREFERRED EMBODIMENTS

The present invention will be described hereinafter with reference to the accompanying drawings.

Figure 1:
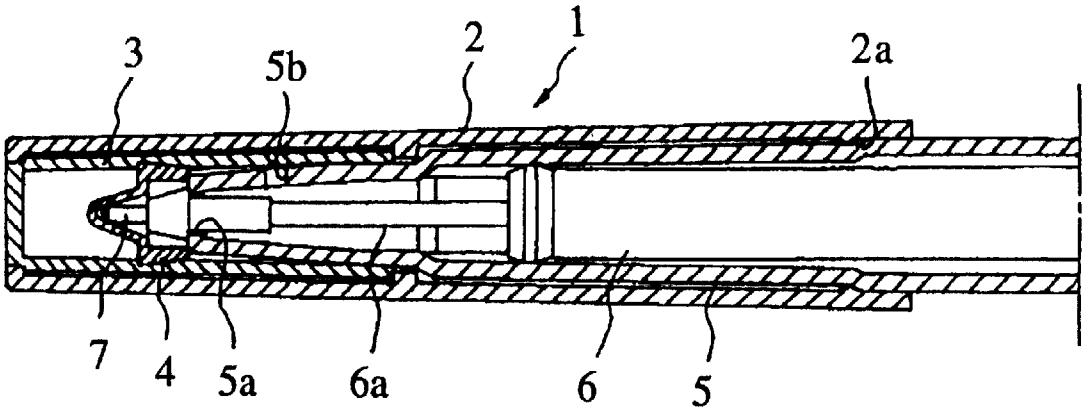
FIG. 1 PRIOR ART
FIG. 1 is a schematic sectional view of assistance in explaining a conventional writing instrument.
Figure 2:
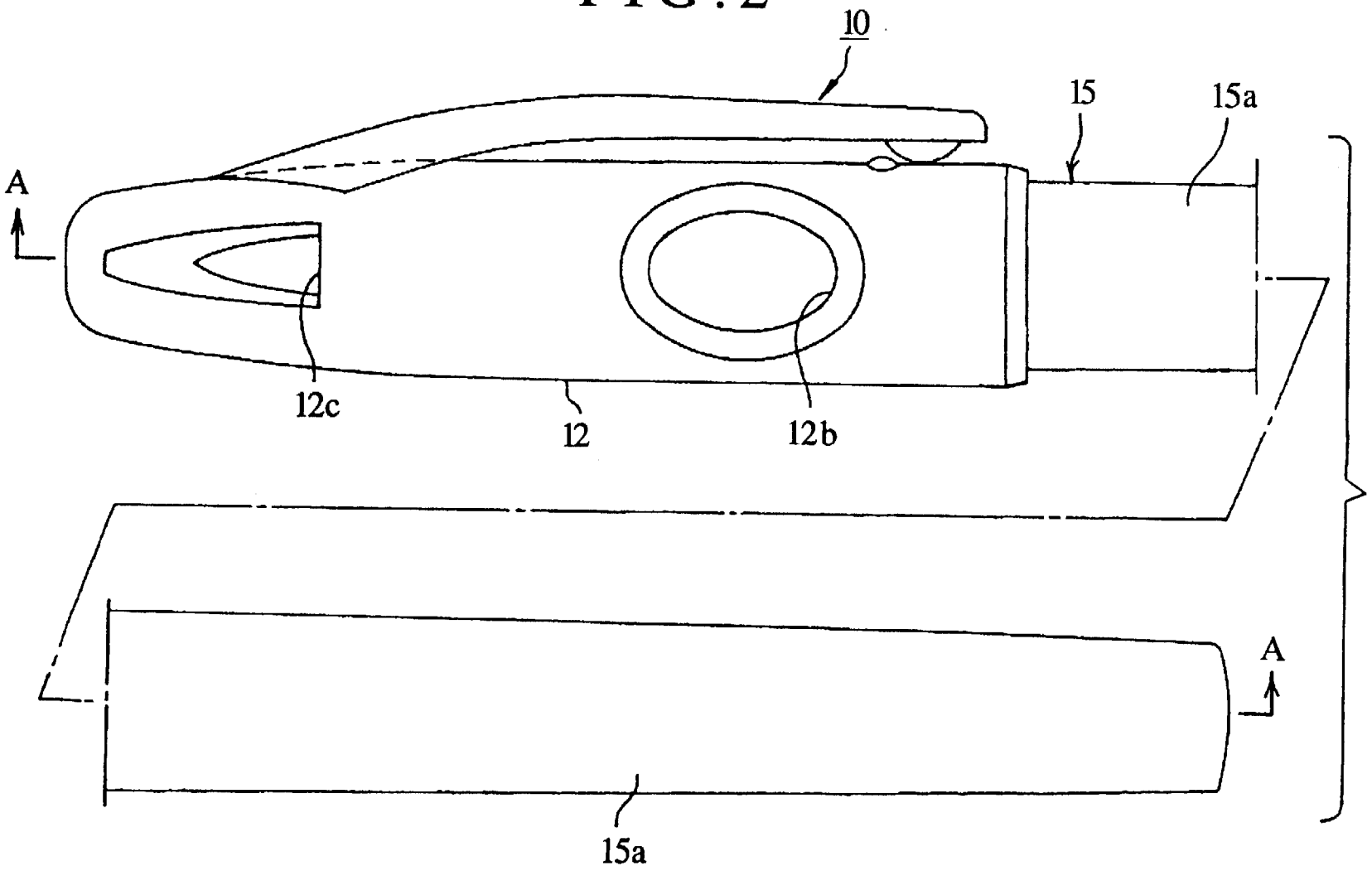
FIG. 2 is a schematic plan view of a writing instrument according to a first embodiment of the present invention.
Figure 3:
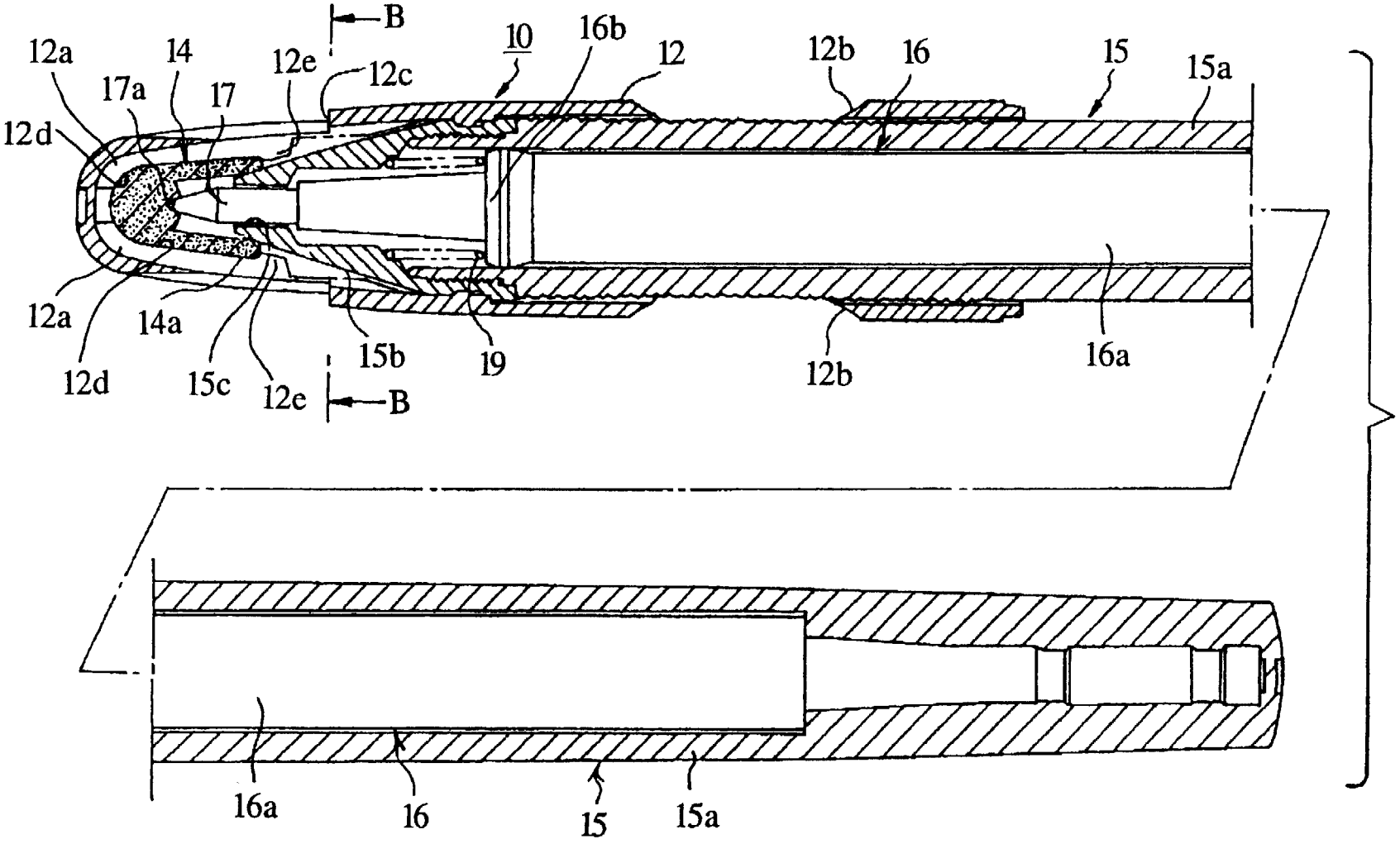
FIG. 3 is a schematic sectional view of the writing instrument of FIG. 2, taken on a plane indicated in FIG. 2 by a line A—A.
Figure 4:
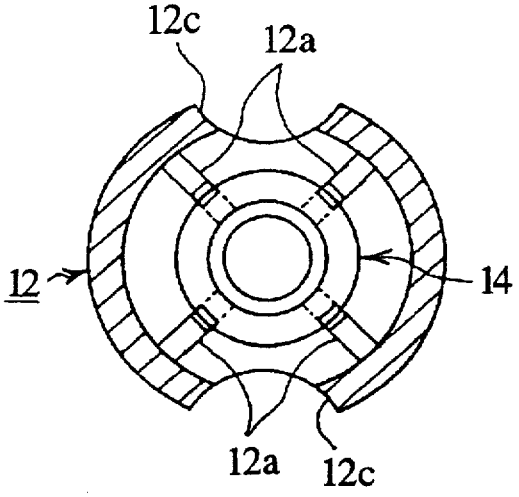
FIG. 4 is an enlarged sectional view of the writing instrument of FIG. 2, taken on a plane indicated in FIG. 3 by a line B—B.

Referring to FIGS. 2 and 3, there is illustrated a ball-point pen with a cap according to a first embodiment of the present invention. The cap 10 comprises a cap body 12 of a substantially U-shape in cross section and a seal member 14 provided in the cap body 12. In the illustrated example, for enhancing an aesthetic effect of the cap 10, a first pair of openings **12*b* and a second pair of openings 12*c*, which are appreciated as ornamental patterns, are formed in the cap body 12. More particularly, the first openings 12*b* are formed in circumferential wall portions near an opened end of the cap body 12 and aligned with each other. Similarly, the second openings 12*c* are formed in circumferential wall portions near a closed end of the cap body 12 and aligned with each other. Each of the openings 12*b*, 12*c* is formed into a desired shape in order to enhance an aesthetic effect. As shown in FIGS. 3 and 4, four elongated ribs 12*a* are integrally formed on an inner surface of the closed end portion of the cap body 12. More particularly, the ribs 12*a* extend in an axial direction of the cap body 12 and are spaced at about 90 degrees around the inner surface of the cap body 12**.

Again referring to FIG. 3, the seal member 14 is formed to have a substantially U-shape in cross section. As will be discussed in greater detail hereinafter, the seal member 14 is mounted in a space surrounded by the ribs **12*a*. In order to facilitate retaining of the seal member 14 in the cap body 12, retaining means may be provided. The retaining means comprises an undercut region 12*d* in each of the ribs 12*a* and a bulged portion 12*e* formed at an end region of each of the ribs 12*a* which is near the opened end of the cap body 12. The seal member 14 is made of elastic material such as synthetic rubber or plastic material, e.g., polyethylene or polypropylene. The seal member 14 is mounted in the space among the four ribs 12*a* of the cap body 12 with an opened end 14*a* thereof facing the opened end of the cap body 12. Assembling of the seal member 14 into the cap body 12 may be easily performed by press-fitting the seal member 14 into the space among the four ribs 12*a* while causing the seal member 14 to be elastically deformed in a radial direction. When the seal member 14 is press-fitted in the space among the ribs 12*a* for assembly, the seal member 14 rides over the bulged portions 12*e* of the ribs 12*a*, and is situated on the undercut regions 12*d* of the ribs 12*a*. At this time, the opened end 14*a* of the seal member 14 is engaged with the bulged regions 12*e* of the ribs 12*a*, so that the seal member 14 is prevented from being removed from the ribs 12*a*. Thus, the seal member 14 is firmly and stably supported by the ribs 12*a* of the cap body 12. Incidentally, in the illustrated example, while four ribs 12*a* are provided, the number of the ribs 12*a*** is not limited to four.

The ball-point pen comprises a body 15, which includes a barrel **15*a* and a substantially cone-shaped head member 15*b* threadedly attached to a head portion of the barrel 15*a*, and a refill 16 inserted in the body 15. The refill 16 has aqueous ink contained in a body thereof and a writing tip 17 connected to a head portion of the refill body 16*a*. A ball 17*a* is rotatably supported at a tip end of the writing tip 17. The refill body 16*a* is formed with an air-inlet (not shown) for allowing air to flow into the refill body 16*a*. The tip end portion of the writing tip 17 is projected out of the head member 15*b* via an opening formed in a tip end portion of the cone-shaped head member 15*b*. A diameter of the opening of the head member 15*b* is larger than an outside diameter of the writing tip 17, so that a clearance (e.g., opening) 15*c* acting as ventilating means and communicating between an interior of the writing instrument and the environment is provided between the writing tip 17 and the head member 15*b*. In the illustrated example, air can flow into the barrel 15*a* via the ventilating means 15*c* and further flow into the refill body 16*a* via the unshown air-inlet of the refill body 16*a*, whereby ink contained in the refill body 16*a* is supplied to the writing tip 17. Provided between the head member 15*b* and a shoulder 16*b* of the refill body 16*a* is a spring 19 which always causes the refill 16 to be urged rearwardly. In the illustrated example, the head member 15*b* is formed separately from the barrel 15*a*. However, the head member 15*b* may be formed integrally with the barrel 15*a***.

When the ball-point pen is coupled with the cap 10, a tip end portion of the ball-point pen which includes the tip end portion of the head member **15*b*, the writing tip 17 and the ventilating means 15*c* is received in the substantially U-shaped seal member 14 and sealed with the seal member 14. At this time, an inner surface of the U-shaped seal member 14 is tightly engaged with an outer surface of the substantially cone-shaped head member 15*b*, so that the tip end portion of the ball-point pen is completely sealed and shut out from the environment. Thus, the cap according to the present invention is capable of preventing ink from evaporating from the writing tip 17 while the ball-point pen is coupled with the cap 10. The seal member 14 is made of elastic material as described above, so that when the leading portion of the head member 15*b* is inserted into the seal member 14, a peripheral wall of the opened end portion of the elastic seal member 14 comes into close contact with the leading portion of the head member 15*b***.

As discussed above, the cap body 12 has the openings **12*b*, 12*c* appreciated as ornamental patterns. However, the existence of such openings 12*b*, 12*c* in the cap body 12 is not a problem, because the seal member 14 can completely seal the leading portion of the ball-point pen which requires airtightness while the ball-point pen is coupled with the cap 10. Thus, the cap body 12 itself does not act as means to seal the leading portion of the ball-point pen, so that the material and shape of the cap body 12** are not restricted.

Figure 5:
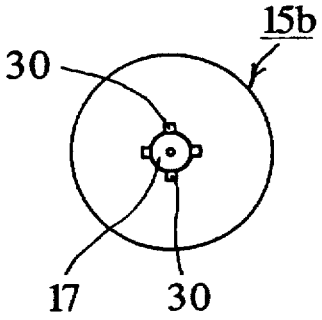
FIG. 5 is a general view of a head portion of a writing instrument according to a second embodiment of the present invention.

Referring to FIG. 5, there is illustrated a second embodiment of the present invention. This embodiment is substantially similar to the first embodiment of FIGS. 2–4 except that different ventilating means is employed. In the illustrated example, an opening of the leading portion of the head member 15b has a diameter substantially equal in size to an outer diameter of the writing tip 17 of the ball-point pen. The ventilating means comprises four channels 30 formed in an inner surface of the opening of the leading portion of the head member 15b and spaced around the inner surface of the opening of the leading portion of the head member 15b. The channels 30 communicate between an interior of the writing instrument body and the environment. In this embodiment, while four channels 30 are provided, the number of the channels 30 is not limited to four.

Figure 6:
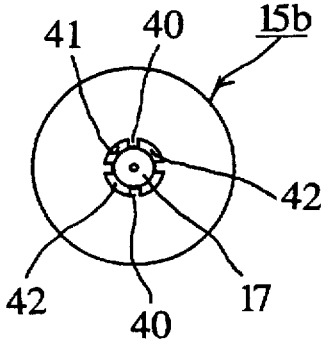
FIG. 6 is a general view of a head portion of a writing instrument according to a third embodiment of the present invention.

Referring to FIG. 6, there is illustrated a third embodiment of the present invention. This embodiment is substantially similar to the above embodiments except that different ventilating means is employed. In the illustrated embodiment, the ventilating means comprises four projections 40 which are formed on a wall of an opening 41 of the leading portion of the head member 15b and spaced around the wall of the opening 41, and four clearances 42 provided between the writing tip 17 and the leading portion of the head member 15b by the existence of the four projections 40. The clearances 42 communicate between an interior of the writing instrument body and the environment. In this example, while four projections 40 are provided, the number of the projections 40 is not limited to four.

Figure 7:
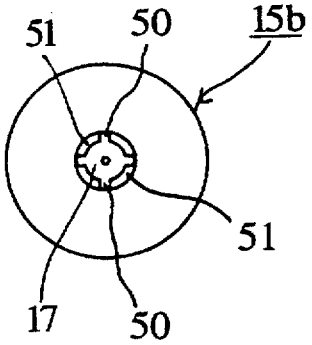
FIG. 7 is a general view of a head portion of a writing instrument according to a fourth embodiment of the present invention.
Figure 8:
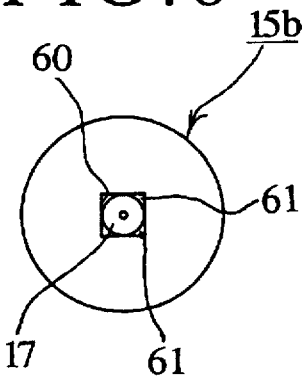
FIG. 8 is a general view of a head portion of a writing instrument according to a fifth embodiment of the present invention.

Referring to FIG. 7, there is illustrated a fourth embodiment of the present invention. This embodiment is substantially similar to the above embodiments except that different ventilating means is employed. In the illustrated example, the ventilating means comprises four projections 50 which are formed on an outer surface of the writing tip 17 and spaced around the outer surface of the writing tip 17, and four clearances 51 provided between the writing tip 17 and the leading portion of the head member 15b by the existence of the projections 50. The clearances 51 communicate between an interior of the writing instrument body and the environment. The number of the projections 50 is not limited to four. Referring to FIG. 8, there is illustrated a fifth embodiment of the present invention. This embodiment is substantially similar to the above embodiments except that different ventilating means is employed. In the illustrated example, an opening 60 of the leading portion of the head member 15b has a diameter substantially equal in size to an outer diameter of the writing tip 17 of the ball-point pen and is formed to have substantially square-shape. The writing tip 17 is formed into a substantially circular cross-section. The ventilating means comprises four clearances 61 provided between the substantially square-shaped opening 60 of the leading portion of the head member 15b and the circular-shaped writing tip 17. The clearances 61 communicate between an interior of the writing instrument body and the environment. The opening 60 of the leading portion of the head member 15b may be formed into a polygonal shape other than a square shape. While the opening 60 of the leading portion of the head member 15b is formed into a substantially square-shape and the writing tip 17 is formed to have a substantially circular cross-section, the opening 60 of the leading portion of the head member 15b and the writing tip 17 may be formed to have a substantially circular-shape and a substantially square cross-section, respectively. In this case, the writing tip 17 may be formed into a polygonal shape other than a square shape.

Incidentally, as long as any clearance means acting as the ventilating means is provided between the leading portion of the head member 15b and the writing tip 17, the cross-sectional shape of the opening of the leading portion of the head member 15b and the cross-sectional shape of the writing tip 17 are not limited. While the ball-point pens utilizing aqueous ink are referred to in the foregoing, the present invention may be applied to a writing instrument utilizing gelatinous low-viscosity ink, a writing instrument utilizing a so-called reservoir, viz., a tubular member having fibrous material contained therein and any ink impregnated in the fibrous material, a writing instrument with a comb-teeth formed writing tip, and a felt-tip pen.

The terms and expressions which have been employed are used as terms of description and not of limitation, and there is no intention in the use of such terms and expression of excluding any equivalents of the features shown and described, or portions thereof, but it is recognized that various modifications are possible within the scope of the invention claimed.

I claim:

1. A cap for a writing instrument, said writing instrument including a body having a tip end, a writing tip projecting from said tip end of said body, ink supplying means for supplying a low-viscosity ink to said writing tip, said ink supplying means having an air-inlet for allowing air to flow into said ink supplying means and ventilating means positioned between said writing tip and said tip end of said body for facilitating the supplying of said ink to said writing tip, said ventilating means communicating between an interior of said writing instrument body and an exterior of said writing instrument body, said ventilating means comprising at least one clearance means, said cap comprising:

a cap body including a closed end having an inner surface and an opened end opposite said closed end;

sealing means for sealing said tip end positioned in said cap body, said sealing means being formed of an elastic material;

supporting means for supporting said sealing means, said supporting means comprising ribs formed on said inner surface of said closed end of said cap body, said ribs being spaced on said inner surface and said ribs including a first end opposite said closed end; and retaining means for retaining said sealing means in said cap body, said retaining means comprising an undercut region formed along each of said ribs and a bulged portion formed at paid first end of each of said ribs.

2. A cap for a writing instrument as in claim 1, wherein when said cap is fitted on said tip end of said writing instrument body, said writing tip and said ventilating means are completely sealed by said sealing means.

3. A combination cap and writing instrument, said writing instrument comprising:

a writing instrument body having a tip end;

a writing tip projecting from said tip end of said writing instrument body;

ink supplying means for supplying a low-viscosity ink to said writing tip, said ink supplying means having an air-inlet for allowing air to flow into said ink supplying means; and ventilating means positioned between said writing tip and said tip end of said body for facilitating the supplying of said ink to said writing tip, said ventilating means communicating between an interior of said writing instrument body and an exterior of said writing instrument body; and said cap comprising:

a cap body including a closed end having an inner surface and an opened end opposite said closed end;

sealing means for sealing said tip end positioned in said cap body, said sealing means being formed of an elastic material;

supporting means for supporting said sealing means, said supporting means comprising ribs formed on said inner surface of said closed end of said cap body, said ribs being spaced on said inner surface and including a first end opposite said closed end; and retaining means for retaining said sealing means in said cap body, said retaining means comprising an undercut region formed along each of said ribs and a bulged portion formed at said first end of each of said ribs.

4. A combination cap and writing instrument as in claim 3, wherein when said cap is fitted on said tip end of said writing instrument body, said writing tip and said ventilating means are completely sealed by said sealing means.

* * * * *